United States Patent [19]

Steixner

[11] Patent Number: 4,800,252

[45] Date of Patent: Jan. 24, 1989

[54] APPARATUS FOR HEATING LIQUID MEDIA BY INFRARED IRRADIATION

[75] Inventor: Fritz Steixner, Stuttgart, Fed. Rep. of Germany

[73] Assignee: Rivi Establishment, Vaduz, Liechtenstein

[21] Appl. No.: 829,784

[22] PCT Filed: Nov. 12, 1983

[86] PCT No.: PCT/EP83/00299

§ 371 Date: Jul. 10, 1984

§ 102(e) Date: Jul. 10, 1984

[87] PCT Pub. No.: WO84/01994

PCT Pub. Date: May 24, 1984

[30] Foreign Application Priority Data

Nov. 16, 1982 [DE] Fed. Rep. of Germany ..... 3242298

[51] Int. Cl.[4] ..... H05B 1/00; F24H 1/12; C10G 7/00

[52] U.S. Cl. ..... 219/306; 99/451; 159/DIG. 6; 196/121; 208/179; 219/275; 219/315; 219/338; 219/354; 219/523; 422/22

[58] Field of Search ..... 219/296–299, 219/301, 303–306, 338, 354, 343, 315, 523, 349, 307, 275; 196/121; 159/DIG. 6; 208/179; 422/22–24; 99/451

[56] References Cited

U.S. PATENT DOCUMENTS

| | | | |
|---|---|---|---|
| 1,551,173 | 8/1925 | Royce et al. . | |
| 1,876,035 | 9/1932 | Tennent | 196/121 |
| 2,357,286 | 9/1944 | Reavell | 159/DIG. 6 |
| 2,954,826 | 10/1960 | Sievers | 219/301 X |
| 3,092,503 | 6/1963 | Gray | 422/22 |
| 3,147,366 | 9/1964 | Dreyfoos | 219/338 X |
| 3,505,172 | 4/1970 | Achener | 219/354 X |
| 3,546,431 | 12/1970 | Gibbs | 219/315 X |
| 3,813,514 | 5/1974 | Canty | 219/338 X |
| 3,906,188 | 9/1975 | Gamell | 219/338 X |
| 3,983,361 | 9/1976 | Wild et al. | 219/338 X |
| 4,042,334 | 8/1977 | Matovich | 219/354 X |
| 4,534,282 | 8/1985 | Marinoza | 99/451 |

FOREIGN PATENT DOCUMENTS

| | | | |
|---|---|---|---|
| 20417 | 4/1930 | Australia | 208/179 |
| 681766 | 9/1939 | Fed. Rep. of Germany | 219/306 |
| 704788 | 4/1941 | Fed. Rep. of Germany | 219/433 |
| 2556892 | 3/1977 | Fed. Rep. of Germany . | |
| 3101547 | 10/1983 | Fed. Rep. of Germany . | |
| 867504 | 8/1941 | France | 219/338 |
| 1305731 | 8/1962 | France | 219/315 |
| 1385146 | 11/1964 | France . | |
| 1559442 | 1/1969 | France | 219/315 |
| 2195676 | 3/1974 | France . | |
| 80191 | 2/1919 | Switzerland | 219/523 |
| 620755 | 12/1980 | Switzerland . | |
| 224497 | 8/1925 | United Kingdom | 196/121 |
| 563945 | 9/1944 | United Kingdom | 159/DIG. 6 |

*Primary Examiner*—Anthony Bartis

*Attorney, Agent, or Firm*—Marmorek, Guttman & Rubenstein

[57] ABSTRACT

An apparatus for heating liquid media, especially for the heating of used oil during its reprocessing by cracking distillation, includes at least one infrared irradiation element located in a vertical cracking vessel. The irradiation elements are separated from the oil to be heated by spaced infrared permeable tubes of quartz glass having cooled intermediate spaces therebetween. The spaced tubes allow the infrared energy to pass unobstracted into the vessel and the intermediate spaces therebetween prevent heat transfer by convection or conduction to the oil. The cracking of the used oil is thus carried out without the formation of undesirable deposits of bituminous substances within the vessel, and especially upon the irradiation elements.

4 Claims, 4 Drawing Sheets

APPARATUS FOR HEATING LIQUID MEDIA BY INFRARED IRRADIATION

Figure 1:
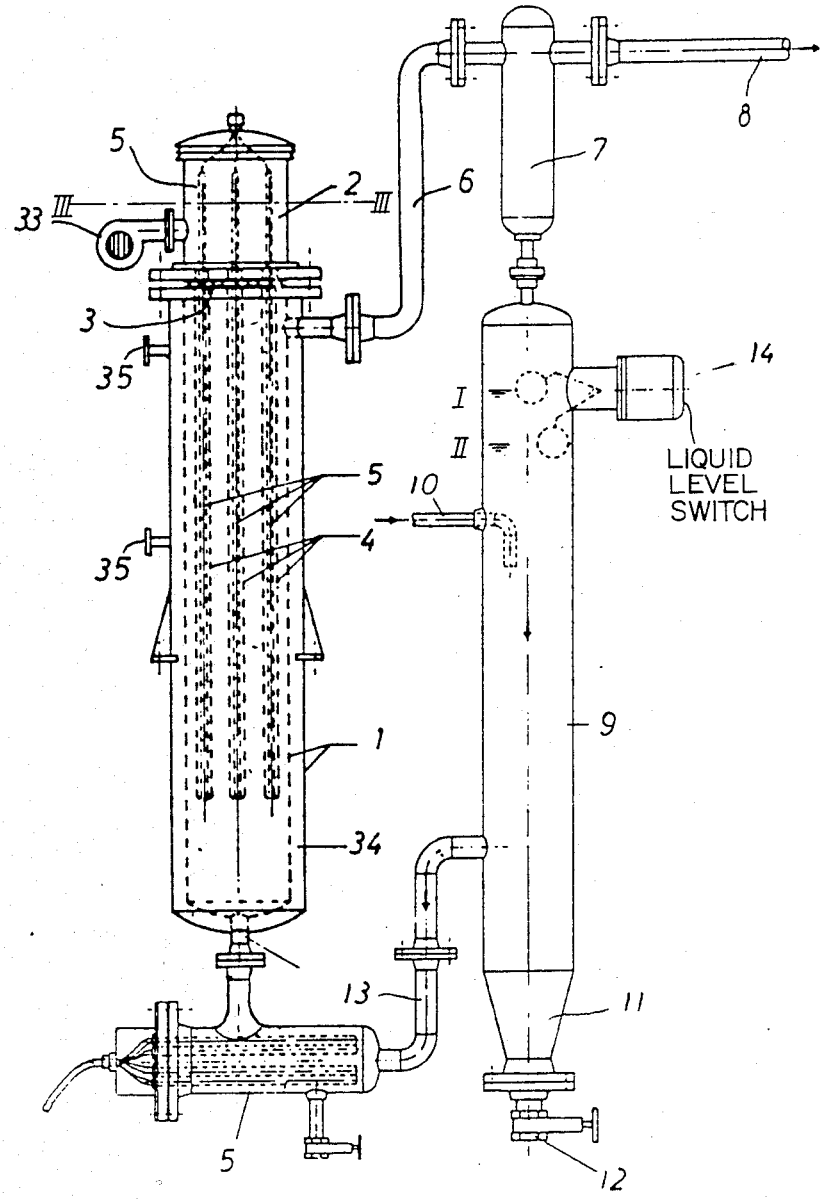

The invention relates to a process and an apparatus for heating liquid media, especially such media, the components of which tend to form deposits.

Liquids or liquid media are usually heated with the aid of heat exchanger tubes or heat exchangers. In this context problems are encountered when the liquids contain components which tend to form deposits, because these deposits precipitate preferably on the heat exchanging surfaces. This condition impairs the exchange of heat and can also reduce the flow area or lead to blockage.

In experiments conducted on the reprocessing of used oil from motor vehicles by cracking distillation, difficulties due to bituminous and carbonaceous deposits on the heating rods projecting into the used oil to be processed were encountered. Such deposits necessitate frequent interruption of the cracking reaction, which impairs the economy of such reprocessing. The carbonized oil residues often set so firmly on the heating rods that they can no longer be removed, and in the course of further operation lead to bursting of the heating rods.

The object of the present invention is therefore to create a process and an apparatus for heating liquids, in which troublesome deposits, especially firmly adhering encrustations, are avoided.

This problem is solved by the liquid medium being heated using ray or wave energy, while the transfer of heat to the medium by conduction and/or convection is essentially excluded. It was surprisingly observed that with such heating undesirable deposits can be avoided. Indeed, such deposits are avoided even when one would expect increased formation or precipitation of solids due to the heating of the medium. Because of the fact that the amount of energy required is injected into the medium to be heated in the form of "cold" energy, namely in the form of rays or waves of suitable wavelength that are absorbed by the medium to be heated, a high temperature difference between the medium and the separating walls, through which the energy is supplied, can be avoided.

In addition to microwaves, short-wave infrared rays, and rays in the range extending from infrared to visible light, are preferred as the form of energy used in the heating process. The wavelength of this short-wave infrared radiation is advantageously between 1000 nm and 800 nm, corresponding to a radiator temperature of between about 1500 degrees K. and 2300 degrees K. But also with lower radiator temperatures e.g., 1000 degrees K., a substantial amount of heat is generated in the radiator, which heats up the radiator components, at least in the area of the irradiation element. To avoid heat transfer in the case of IR radiation by convection or conduction, IR radiators can be used which are separated from the medium to be heated by a ray-permeable insulation. For this purpose separating walls of quartz glass are especially suited. In addition, intermediate spaces between these separating walls can be filled with an insulating gas and/or at least partially evacuated. It is also possible to cool these intermediate spaces, e.g. by circulation of a cooling gas. In this way the outer wall of the radiator or a ray-permeable separating wall coming into contact with the medium can be held at a temperature which does not or only insignificantly exceeds the temperature of the medium to be heated, whereby the undesirable deposits are avoided.

The rays penetrating the medium to be heated are absorbed by said medium, and thereby decrease in intensity with increasing distance from the radiator. Since fast heating of the medium is desired, preferably to temperatures above 200 degrees C., it is advantageous to provide for a combined arrangement of several radiators or to arrange or direct the medium around the radiators in such a manner that the ray density in the medium preferably corresponds at all points to at least the ray density at the half-value penetration depth of a radiator. With the aforementioned IR rays in used oil this value in function of the wavelength lies between 20 and 100 nm.

In this way the rays pass uniformly through the medium to be heated, and cold, unradiated zones are avoided. Furthermore, the medium can be moved, especially mixed, during heating.

The invention is suitable for the heating of media for the most diverse purposes, e.g., for chemical reactions and to conduct distillation processes. In addition, the medium to be heated can be passed through a circuit which is irradiated as a whole or only partly. At suitable points desirable or undesirable products can also be extracted from the circuit. The duration and intensity of the heating are governed by the type of treatment of the liquid medium, and the advantages come to bear at high temperatures, e.g., above 300 degrees C., especially above 400 degrees C.

In a preferred embodiment of the invention an oily medium is heated, especially used oil to obtain combustion and propulsion fuel. The reprocessing of used oil is of special significance with regard to economy and environmental friendliness. The invention has enabled the construction of small, easy-to-handle installations for reprocessing used oil which are of low cost and easy to maintain. Such small installations can be operated, e.g., by companies and governmental authorities with larger vehicle parks.

It is surprising that by using radiation energy oil can be cracked at relatively low temperatures. The processing temperature of used oil is expediently in the range 350 to 700 degrees C., especially in the 400 to 500 degrees C. range. At these relatively low temperatures it is even possible to crack the used oil without specially adding catalysers, however they can be added if desired. The hydrocarbon chains of the oil are directly excited by the radiation, the wave length of which is in the near and visible infrared range, while due to its high energy the radiation favors the cracking process, even though the oil temperature, which can be between 400 and 450 degrees C., is relatively low.

The object of the invention is furthermore to create an apparatus for heating the liquid media, especially an apparatus for reprocessing used oil. This apparatus has at least one vessel with at least one, preferably several irradiation elements. As irradiation elements, IR radiators of known type, furnished with ray-permeable insulation devices against the vessel interior to prevent heat convection and conduction, are especially suited. The irradiation elements preferably have a linear, electrically heated emitter, e.g., a tungsten wire, arranged inside at least two, essentially coaxial tubular insulators. The radiators can be in the shape of a rod, or also bent, e.g., in the form of a coil. The radiators are preferably arranged inside the vessel, in which case an essentially freely suspended arrangement inside the vessel, permitting flow over the radiators by the medium, is especially expedient. An arrangement of parallel rods in a cracking vessel, e.g., in concentric annular arrangement or hexagonal configuration, enables uniform coverage of the entire vessel area with a sufficient radiation density.

The diameter and the wall thickness of the jacket tubes of quartz glass surrounding the radiators for heat insulation can be adapted to meet the respective requirements, depending on whether heating of the tube nearest the medium to be heated by the temperature of the radiator is to be avoided to the extent possible, or whether it can be allowed within certain limits. Such variations are possible because the radiation loss inside the insulation tube is low. Normally, with an IR radiator, which has a heated metal wire and which is arranged essentially centrically in a quartz jacket tube with a diameter of 10 mm, an additional insulation tube with a diameter of about 30 to 40 mm and a wall thickness of about 1 to 2 mm suffices. If the system is operated essentially at atmospheric pressure, which for the sake of simplicity is preferred, then the irradiation elements are not subjected to unexpected mechanical stressing.

Figure 2:
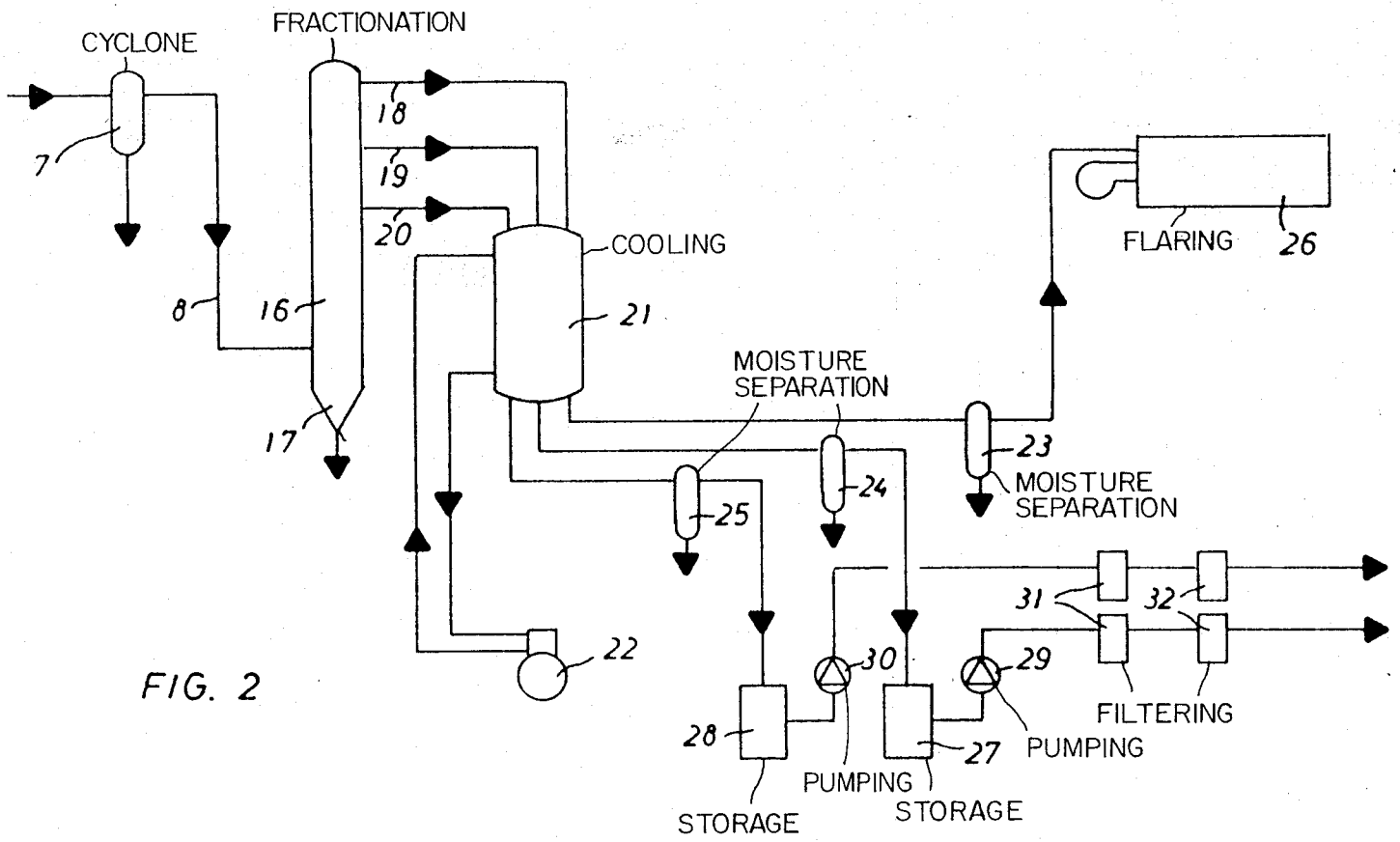
Figure 3:
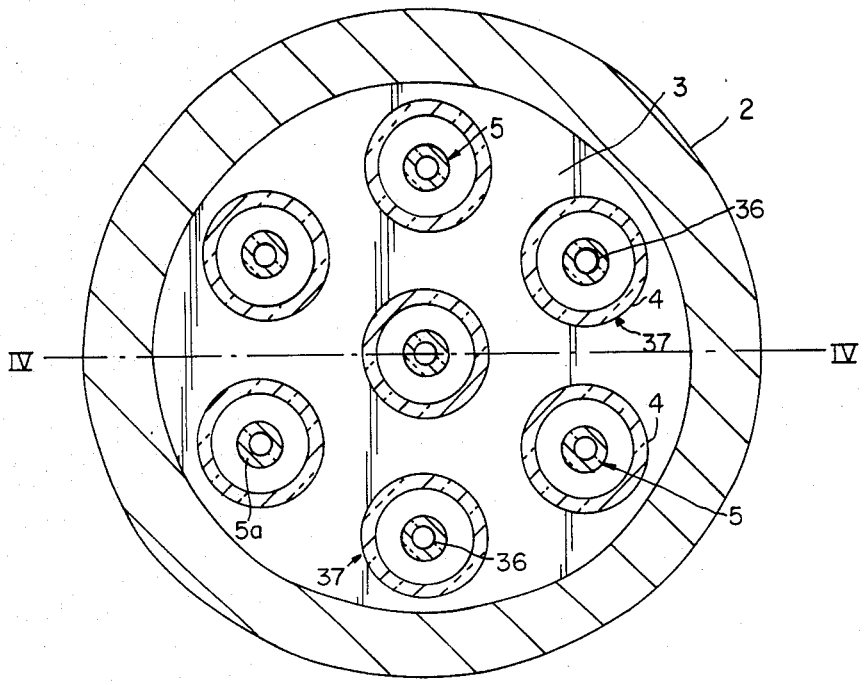
Figure 5:
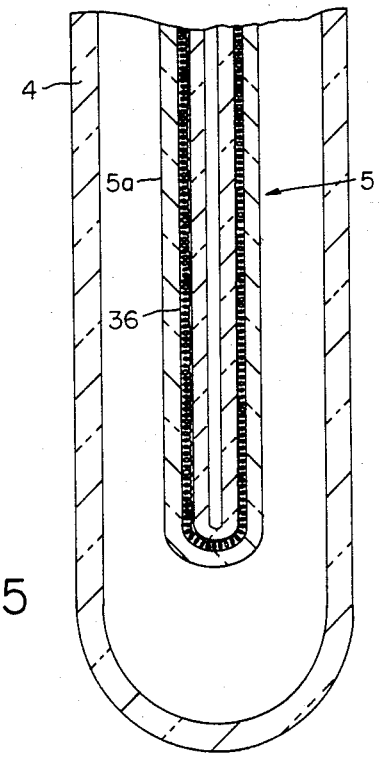
Figure 4:
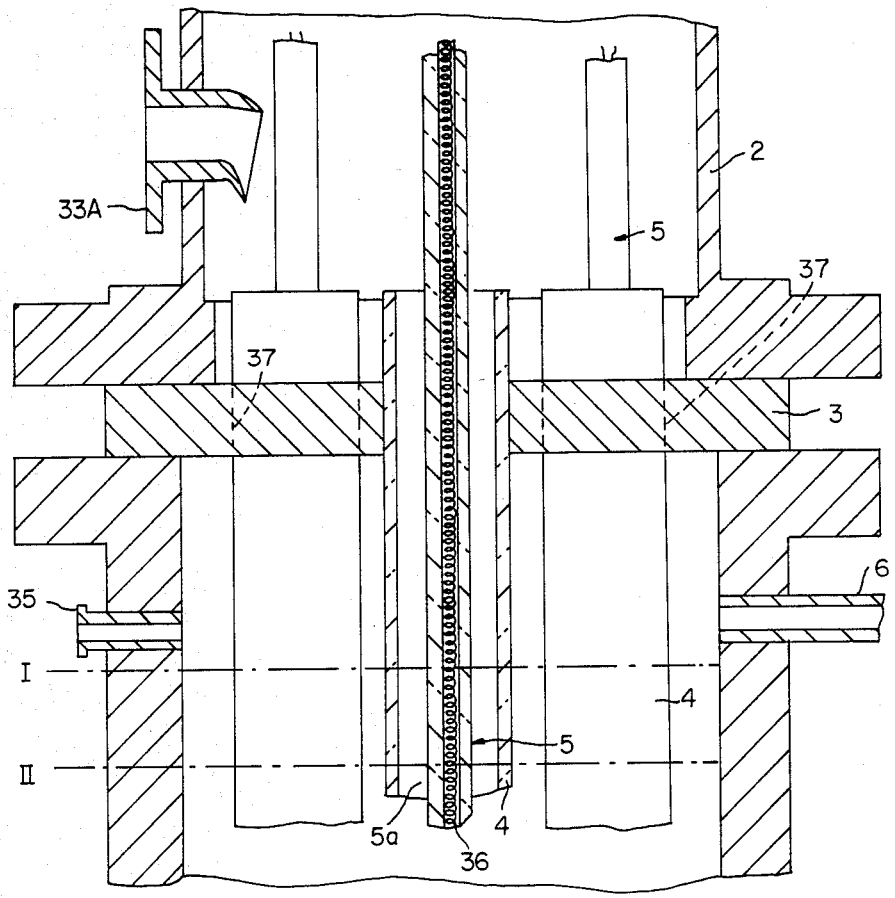

Further characteristics of the invention can ensue from the following description of preferred embodiments in conjunction with the drawing and the claims. Shown in the drawing are:

FIG. 1 a schematic view of an apparatus for cracking used oil;

FIG. 2 a flow diagram indicating the further processing and production of the cracked product, and FIG. 3 a view taken along line III—III of FIG. 1;

FIG. 4 a sectional view taken along line IV—IV of FIG. 3; and FIG. 5 an enlarged sectional view of the lower end portion of a second embodiment of the radiation elements depicted in FIG. 1.

The embodiment shown in the drawings is a small installation for cracking used oil from motor vehicles. The installation has a cracking vessel 1 with an inside diameter of about 300 mm and a height of about 1300 mm. The cracking vessel 1 is arranged vertically, and its upper end is joined by a flange 33*a* to a hood 2. A cover plate 3 in the form of a perforated plate is provided between the hood 2 and the cracking vessel 1, said plate providing sealed separation between the interior of the cracking vessel 1 and the interior of the hood 2. As shown in FIG. 3 the perforated plate 3 has seven holes 37, six holes being arranged hexagonally around the hole in the center. The distance of the holes of hexagonal arrangement from the center point of the perforated plate corresponds to about half the inside radius of the cracking vessel 1. Quartz tubes 4, which project downward into the cracking vessel 1 and end well above the lower end of the cracking vessel, are installed in and form a seal with the perforated plate. At their lower end the quartz tubes 4 serving as insulation are closed or melted shut. The interior of the quartz tubes thereby has no contact with the interior of the cracking vessel 1 or the medium contained therein.

Suspended or inserted in the quartz tubes 4 are infrared heating rods 5. These IR heating rods consist of a quartz tube 5*a*, in which a coil of tungsten wire 36 is centrically installed and held with spacers at a distance from the tube wall. In a preferred embodiment shown in FIG. 5, the tube is preferably a U-shaped, bent dual tube, through which the coil wire descends and ascends, so that two parallel heating wires are provided per heating rod. The heating rod capacity is rated such that in operation a short-wave IR radiation is emitted. In the present case the heating rods have a rating of about 2 KW at 220 volts. In oil the short-wave IR rays have a half-value penetration depth of about 60 mm. Since the center line distance between two heating rods can be held in the order of twice the half-value penetration depth, with the present embodiment it is around 100 mm.

The insulation tubes 4 have an inside diameter of about 35 to 40 mm. Since the quartz tubes allow the IR radiation, as well as the visible portion of the radiation, to pass unobstructed, they are not heated by the radiation. Because of the air space between the heating rods 5 and the insulation tubes 4, heating of the insulation tubes 4 by convection of the air contained therein is low or negligible. The space between the heating rods 5 and the insulation tube can also be cooled by circulating cooling gas. The heating wires inside the IR heating rods 5 end below the height foreseen for the maximum and minimum (see I and II, respectively, in FIGS. 1 and 4) oil level in the cracking vessel 1. This assures that the heating area of the heating rods is always inside the medium to be heated, and that overheating of the overlying parts of the apparatus is avoided. In addition, the hood 2 is also furnished with a cooling device 33 in the form of a blower in order to remove excessive heat.

The cracking vessel 1 itself is either a vessel of double-wall construction with a vacuum space 34 between the walls, or insulated in another suitable manner to avoid heat losses. In addition, the cracking vessel 1 has one or more measurement points 35 to monitor the temperature of the liquid and the gaseous medium.

Below the cracking vessel 1 is a "preheater" 50 in the form of a usual heat exchanger or of a vessel furnished with heating rods. The preheater 50 is flanged tight to the lower end of the cracking vessel 1. From the upper end of the cracking vessel a pipe 6 leads to a cyclone 7, which is charged with the steam escaping from the cracking vessel and which serves to separate entrained liquid and solid components. From the cyclone a further pipe 8 goes to a fractionating apparatus (not shown), in which the obtained product can be separated into gaseous components, as well as gasoline and diesel or fuel oil. The lower end of the cyclone 7 is connected to a mixing vessel 9 which serves as a storage container for the used oil fed in through a supply pipe 10, and which also enables mixing of the material recirculated by the cyclone with the incoming used oil. The lower end 11 of the mixing vessel 9 has a funnel shape and a closable drain 12 for accumulated sludge. Above the funnel-shaped end 11 a connecting pipe 13 goes from the mixing vessel 9 to the preheater 50, so that there is a closed circuit between the cracking vessel 1 and the mixing vessel 9. When the installation is in operation the cracking vessel 1, as well as the mixing vessel 9, are charged with liquid oil up to their upper ends, while the overlying pipe 6 and the cyclone 7 contain essentially vaporized hydrocarbons. An oil level switch 14 arranged in the mixing vessel 9 regulates the liquid level height in the mixing vessel 9 and in the cracking vessel 1 by regulating the incoming used oil flow.

The installation is operated in continuous operation, about one volumetric part of recirculated material being mixed with two parts of new inflowing used oil in the mixing vessel 9. The mixture is thereby brought to a temperature of about 150 degrees C. by the higher temperature of the recirculated material. Due to the large cross-section of the mixing vessel the flow velocity of the mixture in the mixing vessel 9 is relatively low, so that at the funnel shaped end solids can settle out. The mixture, which is essentially free from coarse solids, passes through the connecting pipe 13 into the preheater 5, in which it is heated up to about 200 degrees C. and introduced with this temperature from below into the cracking vessel 1. There, the medium is heated up to about 440 degrees C. by the heating rods 5. Components with a low boiling point can be extracted directly out of the preheater 5 (not shown) to bypass the cracking vessel. Components of the used oil with a higher boiling point are subjected to a cracking reaction in the cracking vessel 1, and escape in the form of gas or steam. In pipe 6 and in the cyclone 7 the steam cools down slightly, so that the recirculated material enters the mixing vessel 9 from above with a temperature of about 350 to 400 degrees C. The entire cracking reaction is effected preferably essentially pressureless, whereby the construction effort can be kept very low. By using the insulated heating rods for heating the used oil up to the cracking temperature, deposits of bituminous substances in the cracking vessel and especially on the heating rods are avoided, so that the installation can run over a prolonged time without servicing.

The flow diagram in FIG. 2 shows the further treatment of the cracked oil after the cyclone 7. The product in the cyclone 7 which has been freed of the liquid and any entrained solid components passes through the line 8 to a fractionating column 16, namely above its lower end 17 which is configured as a funnel-shaped separator. A fractionating column 16 can be one of the well known types used in the liquid level refining industry. Its function is to separate different fractions of oil, for example, by condensing the gas or vapor which is put into the fractionating column 16 through the pipe 8. In the fractionating column 16 three fractions are collected namely a gaseous product in the uppermost line 18, a gasoline-type product in the line thereunder 19, and a diesel-type product in line 20. These three products are cooled separate from one another in a cooler 21, which is connected to a refrigeration unit 22. The outflowing gas or vapor loses a substantial amount of heat in the pipe 6, the cyclone 7, the pipe 8, and the fractionating column 16. However, the separated free fractions are still relatively hot, and under certain circumstances, still vaporized. In order to bring the separated free fractions into a physically stable liquid condition, they must be cooled in the cooler 21. The cooler 21 is operated by a refrigertor 22 known in the art. After cooling, the fractions may still contain gaseous products, which have to be separated from the liquids for safety reasons. The separators 23, 24, 25 can be similar to cyclone 7, to the cooler 21, or the like. The gaseous product is then used immediately for heating purposes, or it is flared as indicated by 26. The useful products of the whole cracking and refining process, such as gasoline and diesel oil, are stored in separate storage vessels 27 and 28. Their outlets lead over the pumps 29 and 30 to mechanical filters 31 or carbon filters 32. The carbon filters 32 also allow the filtering out of some mechanically aggressive substances from the gasoline or diesel oil. Both kinds of filters are well known in the art.

I claim:

1. An apparatus for treating used oil which has at least one component tending to form deposits when in contact with heated surfaces, comprising an elongated cracking vessel, at least one ray-permeable insulating tube disposed within said vessel, at least one wave generator centrally located within and co-linear with said at least one insulating tube, an intermediate space being provided between said at least one insulating tube and said wave generator, each of said at least one wave generator comprising a ray-permeable insulating jacket and a linear irradiating element disposed within said insulating jacket and operative to heat the oil to a temperature above about 350° C., said insulating jacket having a composition substantially the same as said at least one insulating tube, said irradiating element emitting radiant heat energy, said radiant heat energy adapted to heat the oil in order to obtain at least one fraction with a lower boiling point, a hood attached to an end of said vessel, each of said at least one wave generator including an end extending into said hood, each of said at least one insulating tube including an open end extending into said hood and in communication therewith, and cooling means connected to said hood, said cooling means removing excess heat generated by said wave generator, wherein the heating of said at least one insulating tube, said insulating jacket, and said vessel by heat conduction or convection is negligible, and deposits are avoided.

2. An apparatus for treating used oil which has at least one component tending to form deposits when in contact with heated surfaces, comprising an elongated vessel suitable for carrying out the cracking of oil, a first insulating tube disposed within said vessel, a second insulating tube centrally located within and co-axial with said first insulating tube, said second insulating tube having a composition substantially the same as said first insulating tube, an intermediate space being provided between said first and second insulating tubes, an irradiating filament axially disposed within said second insulating tube and operative to heat the oil to a temperature above about 350° C., said irradiating filament emitting radiant heat energy having a wavelength in the range from infrared to visible light, said first and second insulating tubes being permeable to said radiant heat energy, said radiant heat energy being adapted to heat the oil in order to obtain cracking of the oil, a hood attached to an end of said vessel, said first and second tubes each having an end extending into said hood, said intermediate space between said first and second tubes communicating with the interior of said hood, and cooling means connected to said hood, said cooling means removing excess heat generated by said irradiating element, wherein the heating of said first and second insulating tubes and said vessel by heat conduction or convection is negligible, and deposits are avoided.

3. The apparatus of claim 2, wherein said first and second insulating tubes are composed of quartz glass.

4. The apparatus of claim 2, wherein said irradiating filament is composed of a coil a tungsten wire, said irradiating filament being substantially U-shaped.

* * * * *